US008499398B2

(12) United States Patent
Reese et al.

(10) Patent No.: US 8,499,398 B2
(45) Date of Patent: Aug. 6, 2013

(54) SURFACE CLEANING APPARATUS

(75) Inventors: Chad A. Reese, Auburn, AL (US); Mark Rosenzweig, Chestnut Hill, MA (US)

(73) Assignee: Grey Technology Limited

( * ) Notice: Subject to any disclaimer, the term of this patent is extended or adjusted under 35 U.S.C. 154(b) by 0 days.

(21) Appl. No.: 13/041,817

(22) Filed: Mar. 7, 2011

(65) Prior Publication Data

US 2011/0154588 A1 Jun. 30, 2011

Related U.S. Application Data

(63) Continuation of application No. 11/435,920, filed on May 18, 2006, now abandoned.

(60) Provisional application No. 60/737,769, filed on Nov. 18, 2005.

(51) Int. Cl.
*A47L 11/32* (2006.01)

(52) U.S. Cl.
USPC ..... 15/41.1; 15/42; 15/44

(58) Field of Classification Search
USPC ..... 15/41.1, 42, 44
See application file for complete search history.

(56) References Cited

U.S. PATENT DOCUMENTS

| | | | | |
|---|---|---|---|---|
| 1,807,518 | A * | 5/1931 | Flamma | 222/144.5 |
| 4,209,875 | A | 7/1980 | Pugh et al. | |
| 4,685,171 | A | 8/1987 | Beaudoin | |
| 4,709,440 | A * | 12/1987 | Conelly | 15/257.3 |
| 4,928,346 | A | 5/1990 | Elson et al. | |
| 6,009,594 | A | 1/2000 | Grey | |
| 6,055,701 | A | 5/2000 | Grey et al. | |
| 6,101,668 | A | 8/2000 | Grey | |
| 6,243,912 | B1 | 6/2001 | Grey | |
| D494,720 | S | 8/2004 | Rosenzweig et al. | |
| 6,949,130 | B1 | 9/2005 | Grey et al. | |
| 6,968,587 | B2 | 11/2005 | Grey | |
| D515,752 | S | 2/2006 | Rosenzweig | |
| 7,013,521 | B2 | 3/2006 | Grey | |
| 7,017,221 | B1 | 3/2006 | Grey et al. | |
| D521,698 | S | 5/2006 | Rosenzweig et al. | |
| D521,699 | S | 5/2006 | Greene et al. | |
| D526,752 | S | 8/2006 | Rosenzweig | |
| 7,117,556 | B2 | 10/2006 | Grey | |
| 7,152,267 | B2 | 12/2006 | Kaleta | |
| D537,584 | S | 2/2007 | Greene et al. | |
| D549,906 | S | 8/2007 | Rosenzweig | |
| D554,814 | S | 11/2007 | Grey | |

(Continued)

FOREIGN PATENT DOCUMENTS

| | | |
|---|---|---|
| AT | 270121 | 4/1969 |
| EP | 1525839 | 4/2005 |
| GB | 2383527 | 7/2003 |
| WO | 200228251 | 4/2002 |

*Primary Examiner* — Lee D Wilson
*Assistant Examiner* — Shantese McDonald
(74) *Attorney, Agent, or Firm* — Pedersen and Company, PLLC; Ken J. Pedersen; Barbara S. Pedersen

(57) ABSTRACT

A surface cleaning apparatus with a removable compartment is provided that allows a dust cup in the removable compartment to be emptied while minimizing handling by the user. The removable compartment is removably secured within the surface cleaning apparatus. The removable compartment can be removed by activating a first trigger device. The dust cup can be emptied by activating a second trigger device.

24 Claims, 4 Drawing Sheets

U.S. PATENT DOCUMENTS

| | | | | |
|---|---|---|---|---|
| D560,866 | S | 1/2008 | Rosenzweig | |
| 7,329,295 | B2 | 2/2008 | Greene et al. | |
| 7,331,078 | B2 | 2/2008 | Grey | |
| 7,334,284 | B2 | 2/2008 | Grey | |
| 7,341,611 | B2 | 3/2008 | Greene et al. | |
| D568,008 | S | 4/2008 | Grey | |
| 7,475,448 | B2 | 1/2009 | Rosenzweig et al. | |
| 7,571,509 | B2 | 8/2009 | Rosenzweig et al. | |
| 7,802,343 | B2 | 9/2010 | Grey | |
| 7,861,351 | B2 | 1/2011 | Ho | |
| 2001/0054213 | A1 | 12/2001 | Oh et al. | |
| 2004/0074027 | A1 | 4/2004 | Grey | |
| 2004/0186425 | A1 | 9/2004 | Schneider et al. | |
| 2005/0126397 | A1 | 6/2005 | Rosenzweig | |
| 2005/0138764 | A1 | 6/2005 | Grey | |
| 2005/0181968 | A1 | 8/2005 | Policicchio et al. | |
| 2005/0229355 | A1* | 10/2005 | Crouch et al. | 15/352 |
| 2005/0235440 | A1 | 10/2005 | Rosenzweig et al. | |
| 2006/0000040 | A1 | 1/2006 | Grey et al. | |
| 2006/0076035 | A1* | 4/2006 | McGee et al. | 134/6 |
| 2006/0242775 | A1 | 11/2006 | Ho | |
| 2007/0113361 | A1 | 5/2007 | Reese et al. | |
| 2008/0022485 | A1 | 1/2008 | Grey | |
| 2009/0300873 | A1* | 12/2009 | Grey | 15/349 |
| 2010/0229892 | A1 | 9/2010 | Reese et al. | |
| 2010/0236018 | A1 | 9/2010 | Vrdoljak et al. | |
| 2011/0219557 | A1 | 9/2011 | Rosenzweig et al. | |

* cited by examiner

SURFACE CLEANING APPARATUS

CROSS-REFERENCE TO RELATED APPLICATIONS

This application is a continuation of U.S. application Ser. No. 11/435,920, entitled "Surface Cleaning Apparatus", filed May 18, 2006, which is herein incorporated by reference in its entirety, and which claims the benefit under 35 U.S.C. §119 (e) to U.S. Provisional Application No. 60/737,769 filed on Nov. 18, 2005.

BACKGROUND

Electric cleaners, such as sweepers, provide a convenient tool for household cleaning applications. During operation, the dirt, dust, and debris removed from a surface by a cleaner can be collected in a receptacle, such as a dust cup. The dust cup will fill over time and will need to be emptied. Conventional methods typically require a user of the cleaner to manually handle the dust cup in order to empty out the dirt and debris. Such manual handling of the dust cup can result in a substantial amount of debris coming into contact with the user's hands.

SUMMARY

In an embodiment, a surface cleaning apparatus is provided that includes a rotatable brush contained within a forward compartment. A motor is provided for driving the rotatable brush. The surface cleaning apparatus also includes an intermediate compartment comprising a dust cup and a dust removal door, the intermediate compartment being removably secured within the body by a securing structure. A handle is coupled to the intermediate compartment. A first trigger device is operably connected to the securing structure for releasing the intermediate compartment to allow removal of the intermediate compartment, and a second trigger device is provided for opening the dust removal door.

In another embodiment, a surface cleaning apparatus is provided that includes a body and an elongate rotatable brush contained within the body. A motor is provided for driving the rotatable brush. The surface cleaning apparatus also includes a removable compartment comprising a dust cup and a dust removal door, the removable compartment being removably secured within the body by a securing structure. A handle is coupled to the removable compartment. A first trigger device is provided for releasing the removable compartment to allow removal of the removable compartment, and a second trigger device is provided for opening the dust removal door.

In an embodiment, a method is also provided for emptying debris from a surface cleaning apparatus having a removably secured compartment. The method includes activating a first trigger device that is operably connected to a securing structure, and removing a removable compartment from within the body of the surface cleaning apparatus. A second trigger device is then activated to open a door on the removable compartment. This allows dirt or debris captured in a dust cup in the removable compartment to be emptied.

DETAILED DESCRIPTION

In various embodiments, a surface cleaning apparatus is provided that facilitates emptying out of dirt and/or debris contained in the dust cup of the apparatus. The structure of the surface cleaning apparatus allows the dust cup to be emptied while minimizing handling by the user. In particular, various embodiments allow a user to empty dirt, dust, and/or debris from the dust cup without having to directly handle the dust cup prior to emptying or while emptying the dust cup.

Various embodiments of this invention are applicable to surface cleaning apparatuses, such as sweepers and/or vacuum cleaners. An example of sweeper embodiment is provided in FIGS. 1, 2, and 3.

Figure 1:
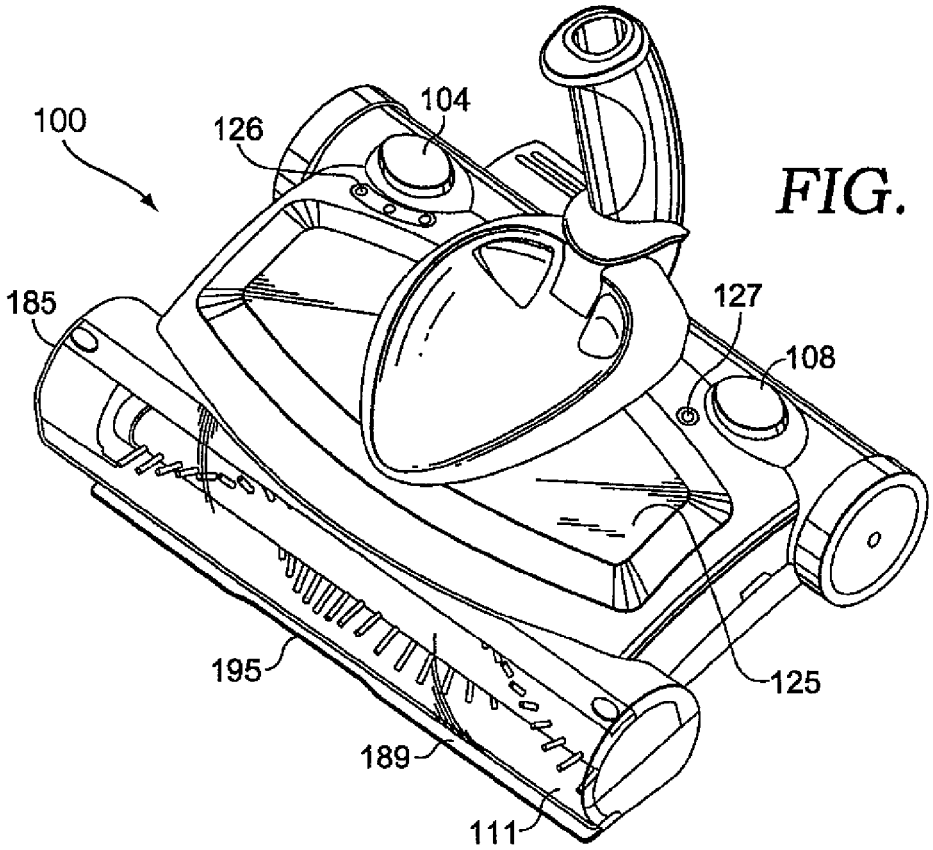
FIG. 1 illustrates an embodiment of a surface cleaning apparatus.

FIG. 1 depicts an embodiment of a surface cleaning apparatus. The embodiment of FIG. 1 includes a body 100, preferably moulded of one or more plastic materials. Body 100 can include 2 or more separate compartments, such as a first and second compartment; a first, second and third compartment; a forward and rear compartment; a forward, intermediate, and rear compartment; or another combination of compartments.

Figure 2:
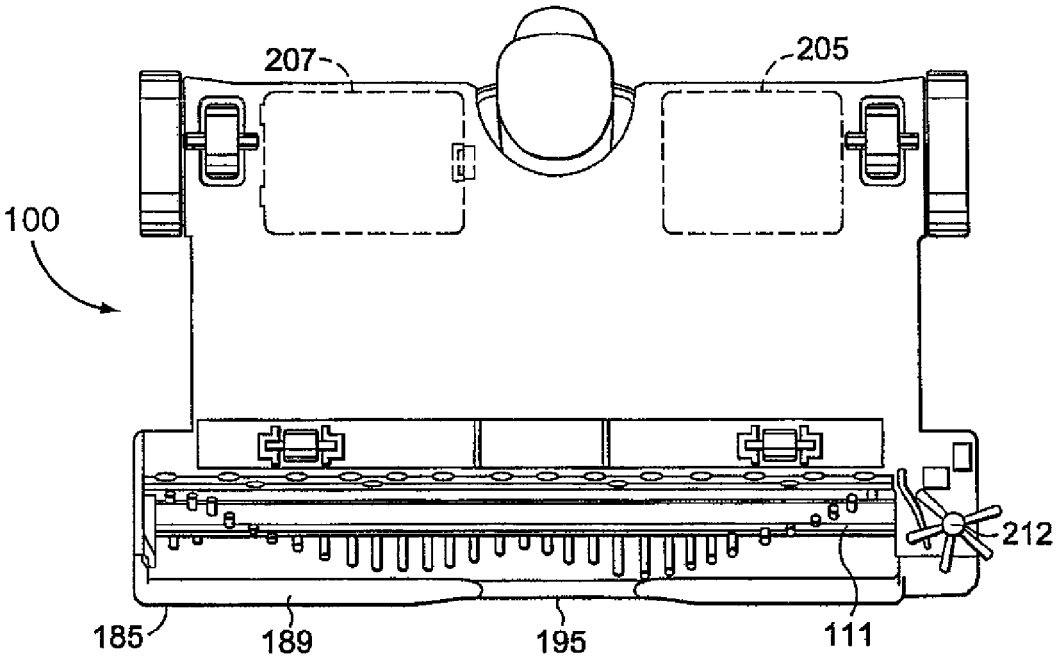
FIG. 2 illustrates an embodiment of a bottom view of a surface cleaning apparatus.
Figure 3:
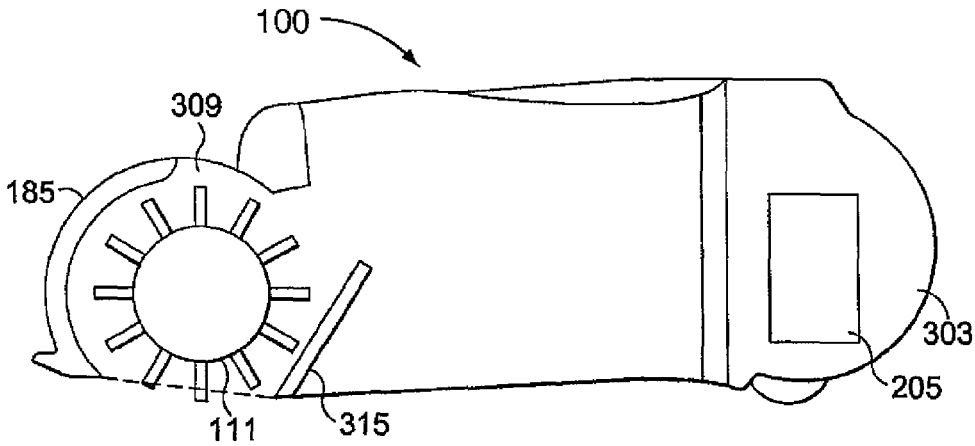
FIG. 3 illustrates an embodiment of a side view of a surface cleaning apparatus.

FIG. 2 shows a bottom view of the embodiment shown in FIG. 1. In this embodiment, body 100 contains an electric motor 205 and a rechargeable battery pack 207. The battery pack can be composed of a single battery or multiple batteries. Indicator 127, shown as a light emitting diode in FIG. 1, indicates whether battery pack 207 is in need of charging. To charge the battery pack, the battery pack may either be connected to a main supply whenever the apparatus is not in use or at suitable times when the battery pack has become depleted. In an embodiment, electric motor 205 and a rechargeable battery pack 207 can be housed in a compartment within body 100. For example, FIG. 3 shows an embodiment of a surface cleaning device having a sealed rear compartment 303. In this embodiment, electric motor 205 and rechargeable battery pack 207 are housed in sealed rear compartment 303. Placing the motor and/or the battery in a separate sealed compartment reduces the risk of dust or other contamination from reaching the motor and/or the battery. In other embodiments, the motor and rechargeable battery pack can be located at various locations within body 100, such as in the main compartment of the body 100, or in one of two compartments, or in one of three compartments, or in one of many compartments. As an alternative to a rechargeable battery pack, the apparatus can include disposable batteries or a disposable battery pack. In still another embodiment, the surface cleaning apparatus can be powered by connection to a main power source, such as by electrically connecting the apparatus to a standard household alternating current outlet.

In the embodiment shown in FIG. 1, a switch 108 is provided to permit a user to turn the motor on and off as desired. Another switch 104 is provided to permit a user to change between various discrete rotational speeds for the motor as desired. In an embodiment, switch 104 is configured to raster up and down through the possible speeds. Thus, if the motor speed was initially in the "low" setting, consecutive pushes of switch 104 would result in the following motor speed settings: Low—Medium—High—Medium—Low. Indicators 126 indicate the current speed of the motor. For example, having one of indicators 126 active can indicate a low speed setting, two indicators can indicate medium speed, while all three being on indicates high speed. Note that in other embodiments, other types of speed selections are possible, such as having a Low and High setting. In still other embodiments, the cleaning apparatus can have a single brush speed. In such embodiments, indicator lights 126 and speed selection switch 104 could be optional.

Body 100 also houses a rotatable brush assembly 111. In an embodiment, rotatable brush assembly 111 includes an elongate rotatable brush. Preferably, rotatable brush assembly 111 is located near the front of body 100, such as in a forward compartment, and extends across substantially the entire width of the body. In an embodiment, the rotatable brush assembly is provided with two helically arranged rows of bristles. Preferably, the rows are helices that twist in opposite directions and meet substantially midway between the ends of the brush assembly. At the location of rotatable brush assembly 111, the bottom body 100 is open to allow the bristles of the brush arrangement to contact a floor, carpet or other surface over which the surface cleaning apparatus is to be moved. In the embodiment shown in FIG. 3, rotating brush assembly 111 is located in forward compartment 309. For convenience a front wall 185 of body 100 can be arcuate to allow the brush assembly to be placed as far forward as possible while still having the forward wall surround the brush assembly.

In the embodiment depicted in FIG. 3, the rotatable brush assembly 111 is located toward the front of body 100. In such an embodiment, the surface cleaning apparatus preferably includes a rearwardly inclined wall 315 located behind the rotating brush assembly and between the brush assembly and a dust cup. The rearwardly inclined wall allows debris, such as dust, dirt and the like, to be propelled up the wall due to rotation of the brush arrangement 111 and away from the opening where the brush arrangement contacts the surface to be cleaned. This reduces the likelihood of dust travelling back toward the brush assembly, even if the body is inclined forward. In an embodiment, the wall 315 extends upwardly to about the same height as the top of the rotating brush assembly 111. In various embodiments, wall 315 is angled toward the rear of the body at an angle of from 15 to 20 degrees, such as 16 degrees, 17 degrees, 18 degrees or 19 degrees.

Optionally, body 100 can also include a headlight (not shown). In an embodiment, the headlight is composed of three light emitting diodes that are shielded by a plastic cover.

The brush assembly can be operably connected to the motor by any suitable method. For example, the motor can be used to drive a belt connected to the brush assembly. In an embodiment, the belt can be housed in a separate compartment within the body to prevent dust or debris from reaching the motor and/or the battery.

FIG. 1 also depicts a front of a cleaning apparatus according to an embodiment of the invention. Bottom surface 189 of the front wall 185 is at a higher elevation relative to the surface being swept than the bottom surface of the sweeper body. In an embodiment, the higher elevation of bottom surface 189 is achieved by having the side wall of the body near the front wall rise away from the surface to be swept. In an embodiment, in the vicinity of the front wall, the side wall is chamfered to rise away from the surface to be swept at an angle of at least 5 degrees and preferably at least 10 degrees. In an embodiment, this angle is 20 degrees or less, preferably 15 degrees or less. In another embodiment the bottom surface 189 of the front wall can also be angled away from the surface to be cleaned. The angle of the bottom surface relative to the surface to be cleaned can be any convenient angle, such as the same angle as the rise angle of the front portion of the side wall described above. In an embodiment, this angle is at least 5 degrees and preferably at least 10 degrees. In an embodiment, this angle is 20 degrees or less, preferably 15 degrees or less.

In embodiments of the surface cleaning apparatus where the bottom surface of the front wall is elevated relative to the bottom surface of the body, the body can be tipped forward to bring the brush arrangement into closer contact with a surface being cleaned. Tipping the body of the cleaning apparatus forward will bring the brush assembly into a position where the bristles of the brush come into contact (or come into closer contact) with the surface to be cleaned. When the body is tipped forward, the bottom surface of the faceplate may also come into contact with the surface to be cleaned. The additional width of the bottom surface of the faceplate provides a larger contact area for the bottom surface, and thus reduces the tendency of the bottom surface to "dig in" when cleaning a soft surface. Instead, the additional width aids the surface cleaning apparatus in being able to slide along a surface to be cleaned when in the tipped forward position.

In still another embodiment, the front wall or faceplate of the forward compartment includes a notch or opening. The notch or opening increases the distance between the bottom surface of the front wall and the surface being cleaned in the region of the notch. The notch or opening provides a location on the front wall of the surface cleaning apparatus where larger particles can be admitted for collection. This is of particular value when the surface cleaning apparatus is being tipped forward so that the bottom surface of the front wall is in contact with the floor.

The height of the notch or opening can be any convenient height that allows particles to be collected by the surface cleaning apparatus while the body is being tipped forward. In an embodiment, the height of the opening relative to the bottom surface of the front wall is the same as the distance from the bottom surface of the front wall to the bottom of the surface cleaning apparatus body. For example, if the bottom surface of the front wall is higher in elevation than the surface to be swept by 1 cm (when the body is not tipped forward), the elevation of the bottom surface in the notch relative to the bottom surface of the rest of the front wall would also be 1 cm. This would lead to a total elevation for the bottom surface of the opening of 2 cm relative to a surface to be swept. In another embodiment, the height of the notch relative to the rest of the front wall is from 0.25 cm to 2.0 cm. In still another embodiment, the height of the notch relative to the rest of the front wall is at least 0.25 cm, or at least 0.5 cm, or at least 1.0 cm, or at least 1.5 cm. In yet another embodiment, the height of the notch relative to the rest of the front wall is 2.0 cm or less, or 1.5 cm or less, or 1.0 cm or less, or 0.5 cm or less.

The width of the notch or opening can be of any convenient size, as long as the width is small enough to prevent undue stress on the front wall when the sweeper body is tipped forward to bring the bristles into closer contact with a surface. Thus, the notch or opening can have various widths, as the width of the front wall can be from 3.5 cm to as large as 20 cm. In other embodiments, the width of the front wall can be at least 5 cm, or at least 7.5 cm, or at least 10 cm, or at least 11.5 cm, or at least 13 cm, or at least 14 cm, or at least 15 cm. In an embodiment, the width of the opening is at least 10% of the width of the front wall and preferably at least 15%. In an embodiment, the width of the opening is 40% or less of the width of the front wall and preferably 25% or less. FIG. 1 shows an example of a notch or opening 195 in a front wall 185.

In still another embodiment, one or more auxiliary brushes may be provided at a side of the rotating brush assembly. FIG. 2 depicts an example of an auxiliary rotary brush 212. Such an auxiliary brush is able to sweep debris into the path of the brush arrangement which might otherwise be missed. The auxiliary brush may be driven by any suitable means, such as a friction/clutch drive, gearing from the brush arrangement, or by friction with the surface to be swept, and is suspended from and extends outwardly beyond the body 100. The auxiliary brush may comprise a conical and/or cylindrical body rotatable about an axis which is inclined to the vertical by at least 5 degrees, or at least 10 degrees, or at least 15 degrees so as to extend outwardly beyond the body 100. In another embodiment, the body can be rotatable about an axis which is inclined to the vertical by 20 degrees or less, 15 degrees or less, or 10 degrees or less. Bristles protrude radially outwardly from the periphery of the cylindrical body, but need not be perpendicular to the axis of rotation.

In yet another embodiment, the aperture for collecting dust and debris can be increased by moving or removing a portion or all of the front wall of the surface cleaning apparatus. Moving or removing a portion of the front wall exposes more of the rotating brush assembly. This increases the ability of a user to expose a surface to be cleaned to the rotating brush. The portion of the front wall can be a sliding portion, a rotating portion, a detachable portion, or any other type of portion that allows for additional exposure of bristles to a surface to be cleaned.

During operation, a surface cleaning apparatus according to the invention is placed on a surface to be swept. When the motor is turned on, the motor drives the rotating brush assembly. This allows the surface cleaning apparatus to sweep debris or dust up into the body for collection, such as in a dust collection compartment. Suction is not required for proper operation of the device. However, in an alternative embodiment, the surface cleaning apparatus of this invention can also be incorporated into a vacuum cleaner.

Structure and Design of Dust Cup

In various embodiments, the surface cleaning apparatus can have at least one removable compartment than includes a dust cup. Within this document, a dust cup can be any type dirt or debris collection volume suitable for use with the various embodiments of a surface cleaning apparatus described herein. The dust cup receives dirt and debris that is swept into the body of the surface cleaning apparatus by the rotatable brush. Preferably the compartment for capturing dirt and particles is a compartment located behind the rotating brush assembly. In such an embodiment, the motor and/or the battery for the surface cleaning apparatus can be sealed off from the dust collection compartment, such as in a sealed rear compartment.

The embodiment shown in FIG. 1 includes a dust cup within a removable compartment 125. Removing the compartment containing the dust cup allows dust and debris to be emptied out of the surface cleaning apparatus. Preferably, at least one wall of the removable compartment forms part of an outer wall of the body 100, such as a top wall or a side wall. In the embodiment shown in FIG. 1, removable compartment 125 forms a portion of the top, side, and bottom walls of body 100.

Figure 4:
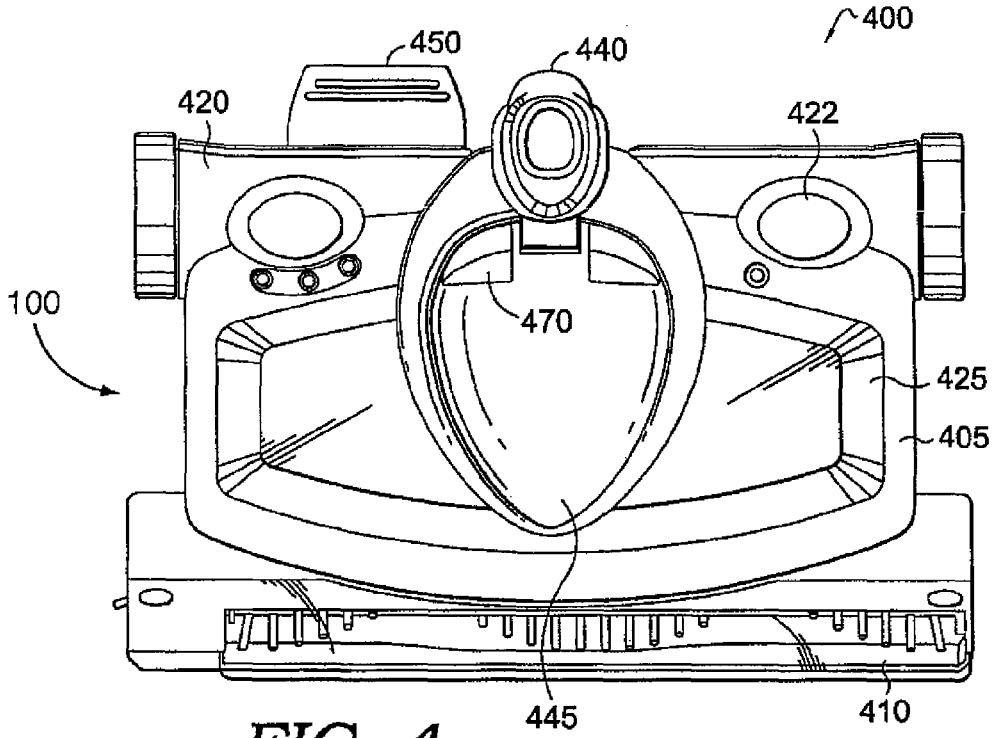
FIG. 4 illustrates an embodiment of a top view of a surface cleaning apparatus.

FIG. 4 shows a top view of another embodiment of a cleaning apparatus. In the embodiment shown in FIG. 4, the cleaning apparatus has a body 400 that includes two portions that can be separated. Debris collection section 425 can be removed from base portion 405.

Base portion 405 can have a design similar to the cleaning apparatus described in FIGS. 1, 2, and 3, a conventional sweeper design, or another suitable design. Base portion 405 includes the wheels for body 400. Forward compartment 410 preferably includes a rotating brush assembly. Rear compartment 420 can include a switch 422 for powering the sweeper, although the switch can be relocated as desired. Handle 440 is attached to removable compartment 425. Preferably, the handle 440 is an elongated handle. In an embodiment, the handle 440 is an elongated telescoping handle. Note that in addition to a dust cup, removable compartment 425 can also include other structures or components. For example, removable compartment 425 can include a transparent or semi-transparent cover to allow a user to view the contents of the dust cup.

In an embodiment, base 405 includes a trigger device 450. Trigger device 450 allows the removable compartment 425 to be removed from a secured position within base portion 405. The trigger device can be, for example, a lever, switch, button, a pedal, or any other device that allows the debris collecting section to be removed from a secured position within a compartment within base portion 405. In an embodiment, the trigger device 450 is large enough to be operated as a foot pedal. When trigger device 450 is depressed, a securing structure attaching removable compartment 425 to base 405 is released, allowing the debris collection section 425 to be lifted out of base 405. The removable compartment 425 is lifted out by lifting with handle 440. The handle 440 is attached to removable compartment 425 by transition region 445. The transition region 445 can be located on any area of the removable compartment 425. For example, the transition region 445 can be on the top, bottom, front, back, side, or within the removable compartment 425. Note that during times when base 405 and removable compartment 425 are removably secured to each other, handle 440 can be used to steer the cleaning apparatus.

The removable compartment 425 can be held in place using an indentation in a wall of the removable compartment. In an embodiment, one or more tabs or flanges from base 405 reside in the indentation, preventing the debris collection section from being lifted out. Activating the trigger device 450 causes the one or more tabs or flanges to move back out of the indentation, which allows the dust cup to be lifted out. Alternatively, the trigger device and tabs or flanges can be located on the removable compartment, while the indentation is located in an interior surface of body 405. In another embodiment, debris collection section 425 has one or more ridges, and base 405 has at least one tab or edge that rests on top of the one or more ridges. In such an embodiment, activating trigger device 450 raises or moves the at least one tab or edge, allowing the one or more ridges to slide by as the debris collection section 425 is lifted out of base 405. In still other embodiments, any convenient electromechanical method for removably securing removable compartment 425 to base 405 can be used, so long as the method allows the removable compartment to be released for removal upon activating a trigger device.

Figure 5:
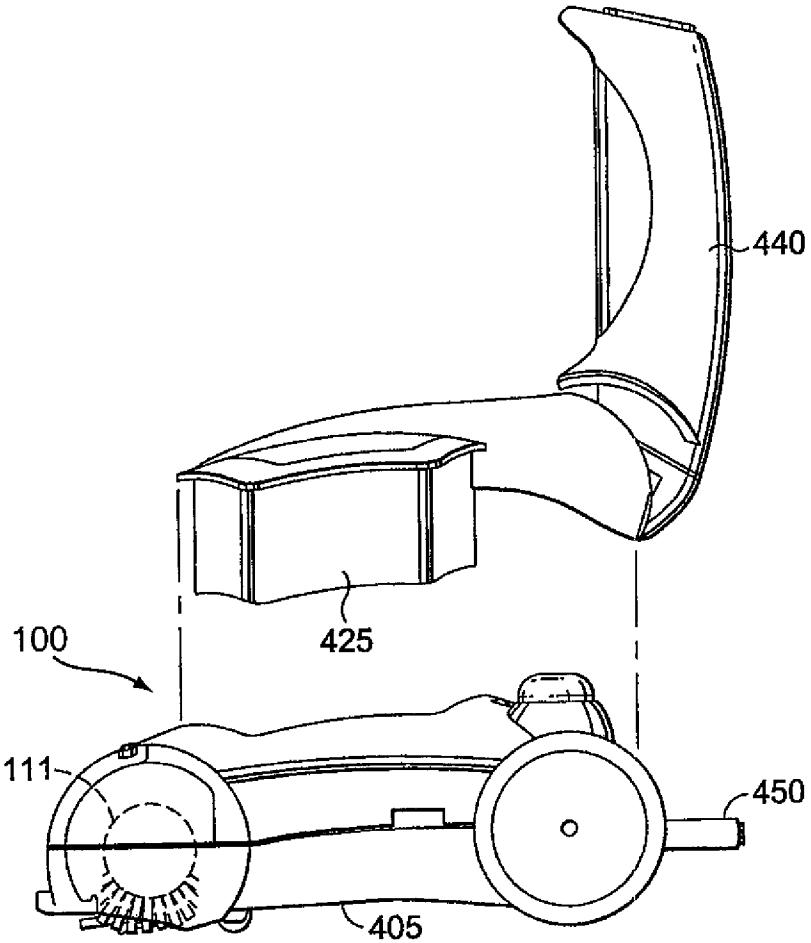
FIG. 5 illustrates an embodiment of a side view of a removable compartment being removed from a base portion.

FIG. 5 provides a side view of a removable compartment 425 being removed from a base portion 405. A rotatable brush assembly 111 is also shown in base portion 405. In various embodiments, after removing a removable compartment from the base, the dust cup within the removable compartment can be emptied. This is accomplished by allowing some or all of the bottom of the removable compartment to swing open. This allows collected dirt and debris to fall out of the dust cup and into a trash bag or other waste receptacle. In other embodiments, some or all of the top, front, back, or sides of the removable compartment can swing open to allow removal of dirt and debris.

Figure 6:
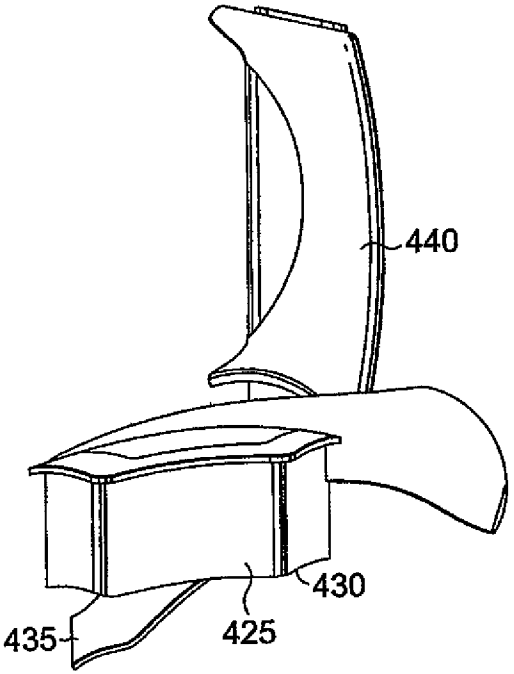
FIG. 6 illustrates an embodiment of a removable compartment.

FIG. 6 shows a front view of an embodiment of a removable compartment 425. Bottom 430 of removable compartment 425 includes a dust removal door 435 that can open from below. The door 435 can be hinged, for example, to allow the door 435 to fall open. This allows dirt and debris contained in removable compartment 425 to fall out. In the embodiment shown in FIG. 6, door 435 is hinged at the middle of bottom 430. The door falls open from the side of the removable compartment 425.

In an embodiment, removable compartment 425 includes a trigger device 470 for opening door 435. Trigger device 470 can be, for example, a lever, switch, button, or any other device that opens door 435. FIG. 4 shows an example of a button 470 on a transition region 445. In other embodiments, the trigger device 470 can be located on any area of handle 440 or on any area of the debris collection section 425. When button 470 is pushed or otherwise activated, door 435 of the bottom 430 is allowed to fall open.

The removable compartment 425 includes a release mechanism that allows the door 435 to open once the trigger device 470 is activated. A release mechanism includes any electromechanical device that cause the door 435 to open when the trigger device is activated. For example, in an embodiment door 435 is held in place using an indentation in the body of the door. In such an embodiment, a tab from debris collection section 425 resides in the indentation, preventing the door from falling open. Activating the trigger device 470 causes the tab to move back out of the indentation, which allows the door to fall open. In another embodiment, door 435 has one or more ridges, and debris collection section 425 has at least one tab or edge that rests on top of the one or more ridges. In such an embodiment, activating trigger device 470 raises or moves the at least one tab or edge, allowing the one or more ridges to slide by as the door 435 falls open away from the bottom 430 of debris collection section 425. In such an embodiment, the release mechanism would include the at least one tab/edge and any other mechanical, electrical, or electro-mechanical device that cause the door to open when the trigger device is activated. Any other convenient method for securing door 435 to debris collection section 425 can be used, so long as the method allows the door to be opened upon activating a trigger device.

As a further example, a portion of the release mechanism for opening door 435 can be a located on the handle 440. The portion of the release mechanism can be, for example, a sliding structure located on handle 440. When the sliding structure is moved, the catch mechanism for door 435 is moved, allowing door 435 to release and drop open. Alternatively, in this type of embodiment, the door 435 can be connected to the sliding structure by a cable or other structure. In such an embodiment, the cable can hold the door in place during normal operation. When the sliding structure is moved, the door opens. When the sliding structure is returned to its initial position, the door closes. In such an embodiment, the sliding structure can have its own mechanism to hold the sliding structure in place. In this type of example, the sliding structure could include a trigger device located on handle 440 that is activated in order to allow the sliding structure to move.

Figure 7:
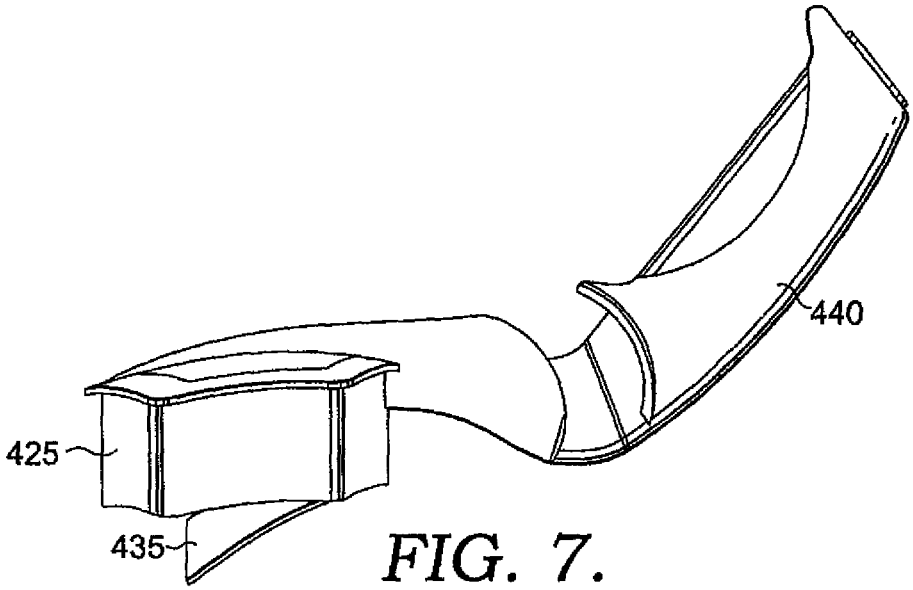
FIG. 7 illustrates a side view of an embodiment of a removable compartment.

FIG. 7 depicts a side view of another embodiment of a removable compartment. In the embodiment shown in FIG. 7, door 435 is hinged to fall open away from the front and toward the rear of removable compartment 425. Note that although door 435 is shown in the middle of removable compartment 425, door 435 can be located in any convenient location on the bottom, top, or side of removable compartment 425. More generally, door 435 can have any convenient location and can fall open in any convenient direction.

Figure 8:
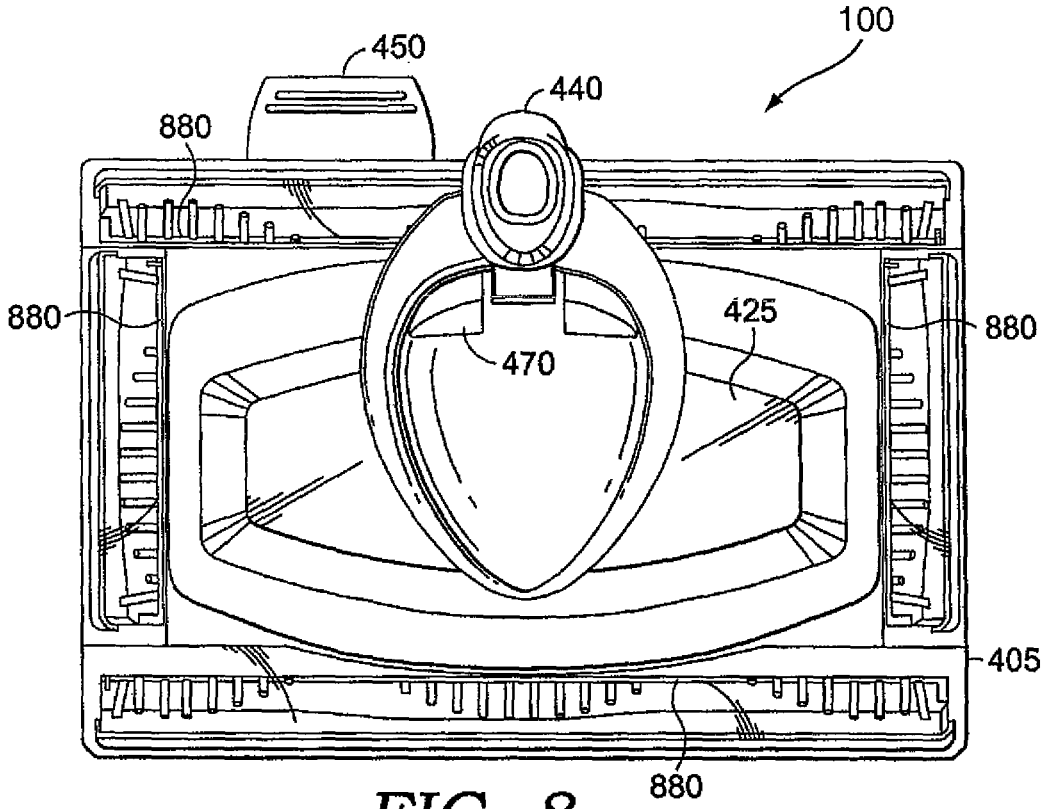
FIG. 8 illustrates a top view of another embodiment of a surface cleaning apparatus.

FIG. 8 depicts a top view of another embodiment of a cleaning apparatus. In the embodiment shown in FIG. 8, base 405 is a base for a sweeper having multiple rotating brush assemblies 880 and a removable compartment 425. As depicted, base 405 includes four rotating brush assemblies 880, although any other number could be included in base 405. Also as depicted, base 405 includes four auxiliary brushes 890, although any other number of auxiliary brushes could be included in base 405. In an embodiment, rotating brush assemblies 880 can be driven by a single motor and connected by gears, or the brushes can be driven by any other convenient method, such as direct drive or belts and pulleys.

An apparatus as described above allows for an improved method of emptying dust and/or debris out of a cleaning apparatus. The various embodiments allow a user to empty out collected dust while reducing contact between the user and the collected dust and/or debris. In an embodiment, a cleaning apparatus according to the invention can be used to remove dirt from a surface and collect the dirt in a dust cup in a removable compartment. After collecting the dirt, the removable compartment of the cleaning apparatus is separated from the base. For example, a trigger device on the base can be activated, which triggers a release mechanism. Once the release mechanism is triggered, the removable compartment can be lifted out of the base, such as by using a handle attached to the removable compartment. In an embodiment where the removable compartment is separated by pressing down on a trigger device such as a foot pedal, a user can avoid touching the removable compartment by hand.

After separating the removable compartment from the base, the removable compartment can be placed over a waste container, such as a trash can or bag. A door in the bottom of the removable compartment can then be opened to allow dirt to fall out of the debris collection section and into the trash can or bag. In an embodiment, the door can be opened by activating a trigger device. Activating the trigger device triggers a release mechanism, which allows the door to fall open due to gravity and/or the weight of material resting on the door. The door is then closed by pressing the door back into the bottom of the removable compartment, which allows the release mechanism to engage the door and hold it in place. Note that using a trigger device to activate the release mechanism allows the user to avoid handling the door or the bottom of the removable compartment until after the debris has been emptied out of the removable compartment.

After emptying the removable compartment, the removable compartment can again be removably secured to the base for further cleaning. In an embodiment, the removable compartment is inserted into the base. The securing structure within the base secures the removable compartment so that the removable compartment cannot be removed unless the trigger device is activated again.

In another embodiment, the door is opened by activating a trigger device that moves a sliding portion on the handle. The sliding portion is connected to the door by a cable or other structure with sufficient rigidity to translate force. By moving the sliding portion, the cable can trigger a release mechanism, allowing the door to fall open. Alternatively, the cable attached directly or indirectly to the door. In such an embodiment, the door will open when the sliding portion is moved one direction. Moving the sliding portion in the opposite direction will close the door. In this latter embodiment, the user does not need to handle the door either during opening or closing, which further reduces contact between the user and any collected dirt.

While particular embodiments of the invention have been illustrated and described in detail herein, it should be understood that various changes and modifications might be made to the invention without departing from the scope and intent of the invention. The embodiments described herein are intended in all respects to be illustrative rather than restrictive. Alternate embodiments will become apparent to those skilled in the art to which the present invention pertains without departing from its scope.

From the foregoing it will be seen that this invention is one well adapted to attain all the ends and objects set forth above, together with other advantages, which are obvious and inherent to the system and method. It will be understood that certain features and sub-combinations are of utility and may be employed without reference to other features and sub-combinations. This is contemplated and within the scope of the appended claims.

What is claimed:

1. A surface cleaning apparatus, comprising:

a body including a forward compartment;

a rotatable brush located in the forward compartment;

a motor configured to drive the rotatable brush;

a rearwardly inclined wall behind the rotatable brush, the rearwardly inclined wall being configured such that debris is propelled up the wall due to rotation of the rotatable brush;

a removable compartment behind the rotatable brush, the compartment comprising a dust cup and a dust removal door, the removable compartment being removably secured within the body by a securing structure;

a handle coupled to the body;

a first trigger device operably connected to the securing structure and configured to release the removable compartment to allow removal of the compartment from the body; and a second trigger device configured to open the dust removal door, wherein the handle is coupled to the removable compartment and is configured to be used to steer the apparatus.

2. The surface cleaning apparatus of claim 1, wherein the handle is configured to allow the removable compartment to be lifted out of the body with the handle.

3. The surface cleaning apparatus of claim 1, wherein the second trigger device is operably connected to the dust removal door by a cable.

4. The surface cleaning apparatus of claim 1, wherein a bottom of the removable compartment is positioned lower than a top of the rearwardly inclined wall.

5. A surface cleaning apparatus, comprising:

a body;

an elongated rotatable brush contained within the body;

a motor for driving the rotatable brush;

a rearwardly inclined wall behind the rotatable brush, the rearwardly inclined wall being configured such that debris is propelled up the wall due to rotation of the elongated rotatable brush;

a removable compartment behind the rearwardly inclined wall comprising a dust cup and a dust removal door, the removable compartment being removably secured within the body by a securing structure;

a handle coupled to the removable compartment;

a first trigger device operably connected to the securing structure for releasing the removable compartment to allow removal of the removable compartment from the body; and a second trigger device for opening the dust removal door, wherein the handle is configured to be used to steer the apparatus.

6. The surface cleaning apparatus of claim 5, wherein the first trigger device comprises a lever, a pedal, a switch, or a button.

7. The surface cleaning apparatus of claim 5, wherein the securing structure comprises a flange or a tab.

8. The surface cleaning apparatus of claim 7, wherein the securing structure is located on the removable compartment.

9. The surface cleaning apparatus of claim 5, wherein the second trigger device comprises a lever, a pedal, a switch, or a button.

10. The surface cleaning apparatus of claim 5, wherein the second trigger device is located on the handle.

11. The surface cleaning apparatus of claim 5, wherein the second trigger device is located on the removable compartment.

12. The surface cleaning apparatus of claim 5, wherein the body comprises a plurality of compartments, the removable compartment being an intermediate compartment.

13. The surface cleaning apparatus of claim 5, wherein a bottom of the removable compartment is positioned lower than a top of the rearwardly inclined wall.

14. The surface cleaning apparatus of claim 5, wherein the handle is configured to allow the removable compartment to be lifted out of the body with the handle.

15. A surface cleaning apparatus comprising:

a body comprising a front section, an intermediate second and a rear section;

an elongate rotatable brush rotatably mounted in the front section;

a motor configured to drive the rotatable brush;

a handle coupled to the body;

a dust compartment in the intermediate section;

a rearwardly inclined wall, wherein the rearwardly inclined wall is positioned to allow debris to be propelled into the dust compartment, the rotatable brush and the rearwardly inclined wall being configured to propel debris up the wall by rotation of the rotatable brush a dust removal door positioned at a bottom of the dust compartment, the dust removal door being selectively movable between an open position and a closed position, the dust compartment being open when the door is in the open position and the dust compartment being closed when the door is in the closed position; and a trigger device operably connected to the dust removal door and configured to selectively allow the dust removal door to move to the open position, wherein the handle is configured to be used to steer the apparatus wherein the intermediate section is removable from the body, and wherein the handle is connected to the intermediate section and configured to allow the intermediate compartment to be lifted out of the body with the handle.

16. The cleaning apparatus of claim 15, wherein the trigger device comprises a button, a switch or a lever.

17. The cleaning apparatus of claim 15, wherein the trigger device comprises a button, a switch or a lever disposed on or in the body.

18. The cleaning apparatus of claim 15, wherein the motor is sealed off from the dust compartment.

19. The surface cleaning apparatus of claim 15, wherein the dust removal door is hinged to the dust compartment.

20. The surface cleaning apparatus of claim 15, wherein a bottom of the removable compartment is positioned lower than a top of the rearwardly inclined wall.

21. A surface cleaning apparatus comprising:

a body;

a handle coupled to the body;

an elongate rotatable brush within the body;

a motor for driving the rotatable brush;

a rearwardly inclined wall behind the rotatable brush;

a dust cup located behind the rearwardly inclined wall to receive dirt and debris that is swept into the body of the surface cleaning apparatus by the rotatable brush, wherein the dust cup contains a movable dust removal door configured for selectively opening and closing the dust cup at a bottom of the dust cup; and a trigger device operably connected to the dust removal door and configured to selectively open the dust removal door, wherein the handle is coupled to the dust cup, and wherein the handle is configured to be used to steer the apparatus.

22. The cleaning apparatus of claim 21, wherein the trigger device comprises a button, a switch or a lever.

23. The cleaning apparatus of claim 21, wherein the trigger device comprises a button, a switch or a lever disposed on or in the body.

24. The surface cleaning apparatus of claim 21, wherein a bottom of the dust cup is positioned lower than a top of the rearwardly inclined wall.

* * * * *